United States Patent [19]

Cain

[11] 4,377,018

[45] Mar. 22, 1983

[54] CLEANING DEVICE FOR SURFACES

[75] Inventor: Gerald E. Cain, North Canton, Ohio

[73] Assignee: Roto Cleaner, Inc., North Canton, Ohio

[21] Appl. No.: 277,037

[22] Filed: Jun. 24, 1981

[51] Int. Cl.[3] ..... A47L 11/30

[52] U.S. Cl. ..... 15/322; 15/321; 15/345

[58] Field of Search ..... 15/320, 321, 322, 345, 15/346

[56] References Cited

U.S. PATENT DOCUMENTS

| | | | |
|---|---|---|---|
| 4,037,290 | 7/1977 | Rose et al. | 15/355 |
| 4,107,816 | 8/1978 | Matthews | 15/322 X |
| 4,191,589 | 3/1980 | Halls et al. | 15/322 X |
| 4,205,412 | 6/1980 | Weber | 15/420 X |

FOREIGN PATENT DOCUMENTS

| | | | |
|---|---|---|---|
| 744466 | 2/1956 | United Kingdom | 15/345 |

*Primary Examiner*—Chris K. Moore
*Attorney, Agent, or Firm*—Frease & Bishop

[57] ABSTRACT

A mobile cleaning device for large flat surfaces includes a housing which forms a spray chamber having an open bottom. A first pair of exhaust ducts is mounted on the front and rear walls of the housing, and a second pair of exhaust ducts is mounted on the top wall of the housing adjacent the housing side walls for removing the debris and spent cleaning fluid from within the spary chamber as the device is moved along a surface being cleaned. An improved fluid-powered rotor is mounted on the housing and rotatably mounts and drives a plurality of fluid spray nozzles by use of the back pressure exerted by the cleaning fluid as it is sprayed from the nozzles against the surface being cleaned. The rotor is provided with an effective seal for the high pressure fluid with respect to the stationary components adjacent the movable rotor. The exhaust ducts are connected to a source of suction through a manifold in which the total area of the exhaust duct openings on the inlet side of the manifold is equal to the area of the suction opening on the outlet side of the manifold. Wheels movably adjustably mount the housing with respect to the surface being cleaned enabling the total areas of the inlet air passages formed between the bottom edges of the housing and surface to be equal to the total area of the exhaust duct openings to achieve a highly efficient suction.

26 Claims, 16 Drawing Figures

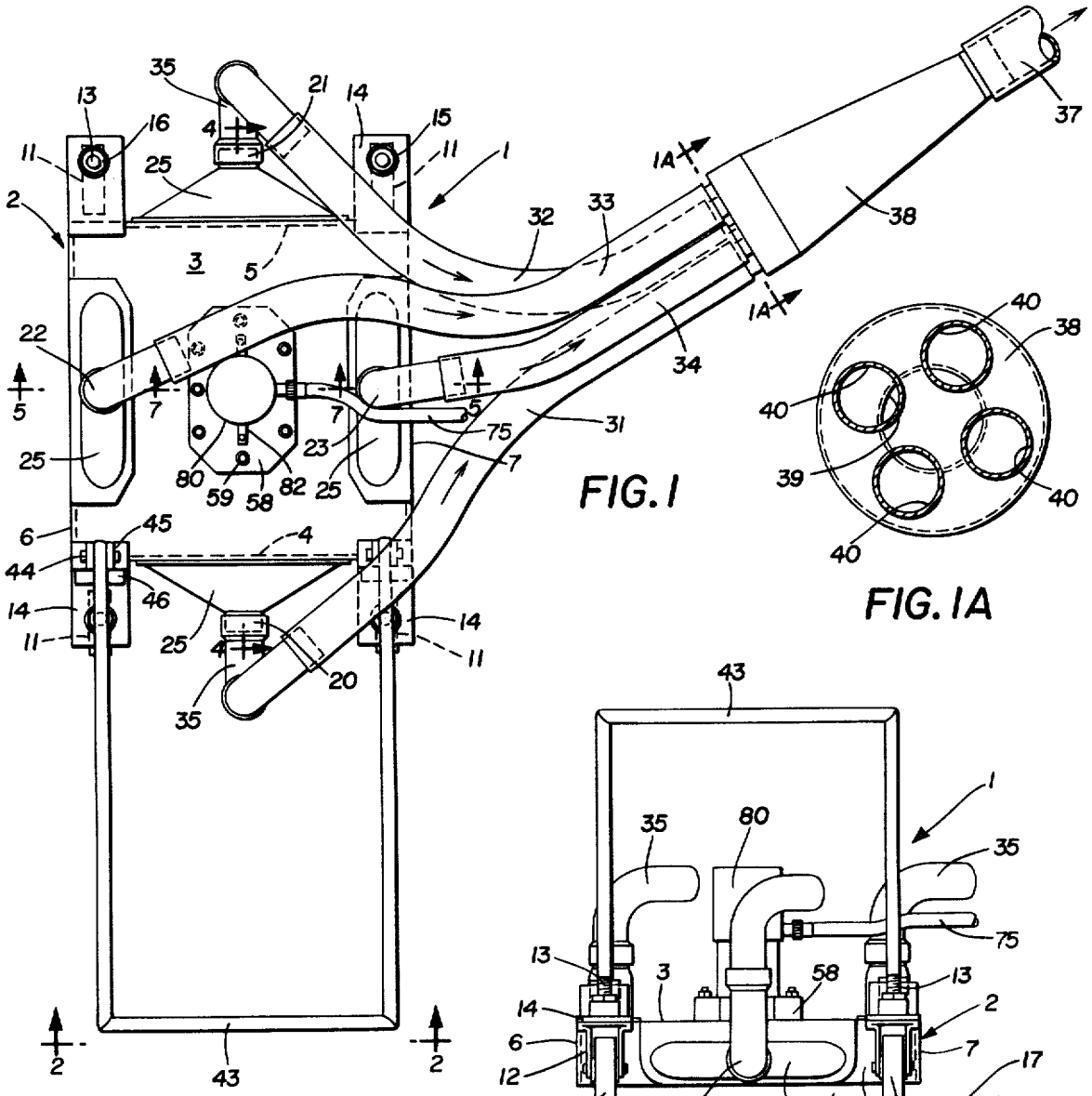
FIG. 1
FIG. 1A
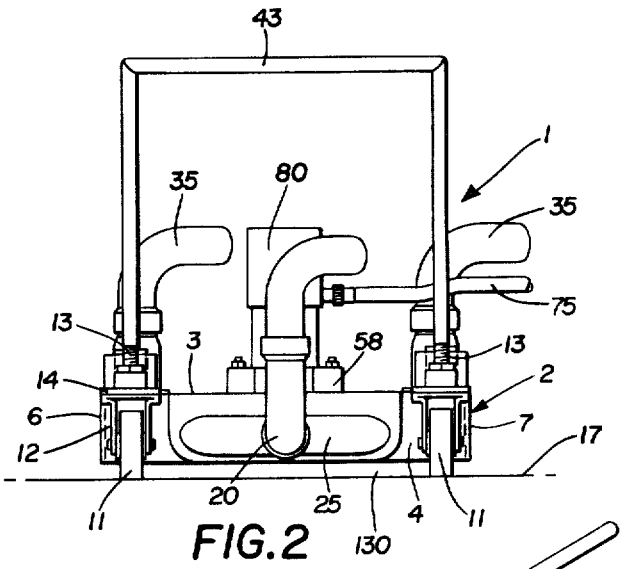
FIG. 2
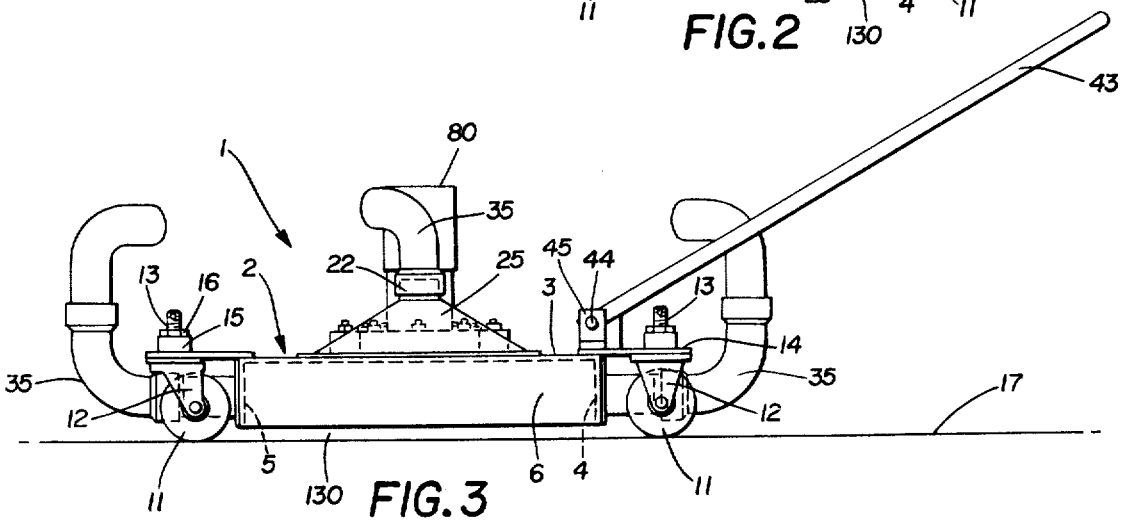
FIG. 3

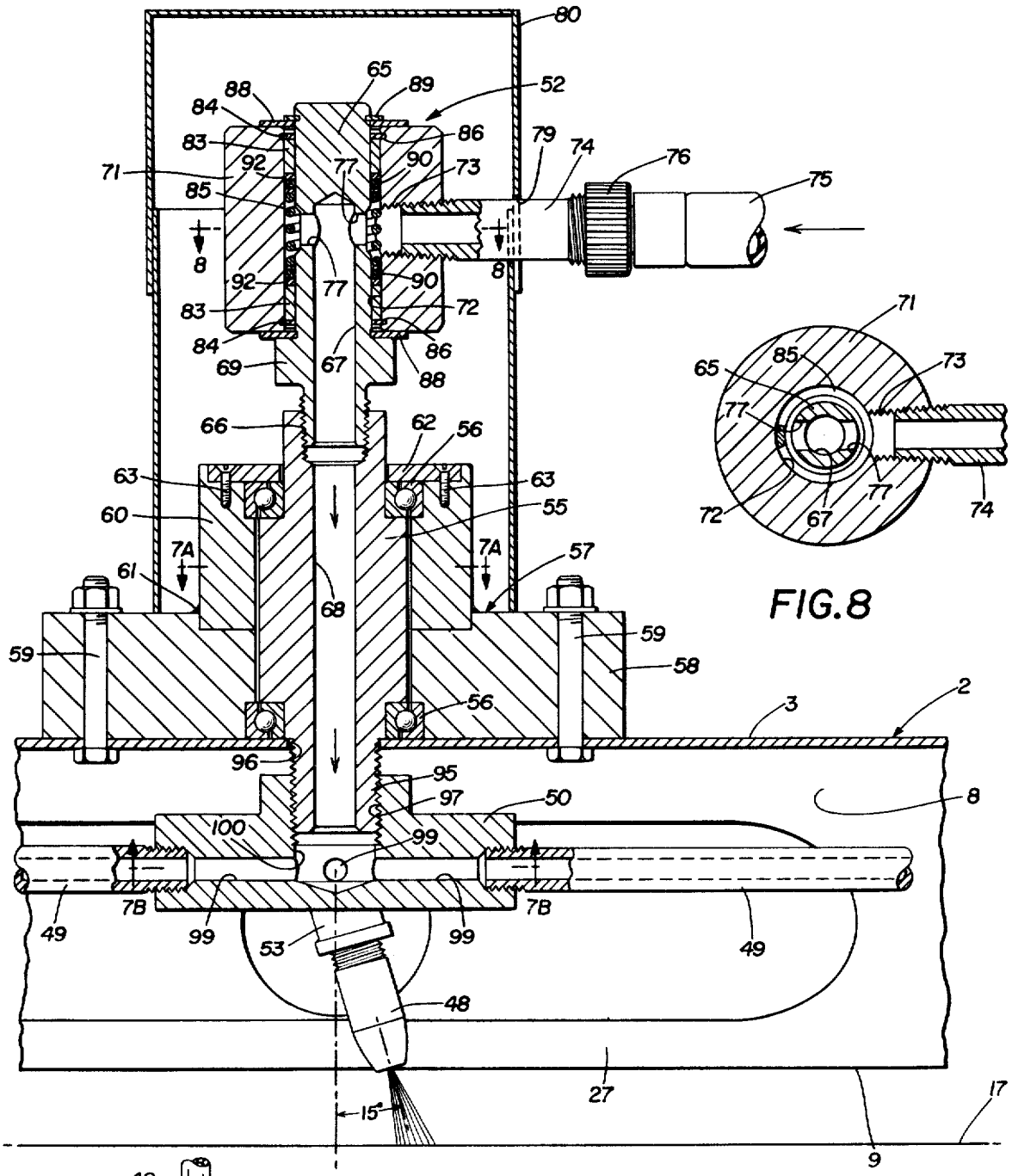
FIG.7
FIG.8
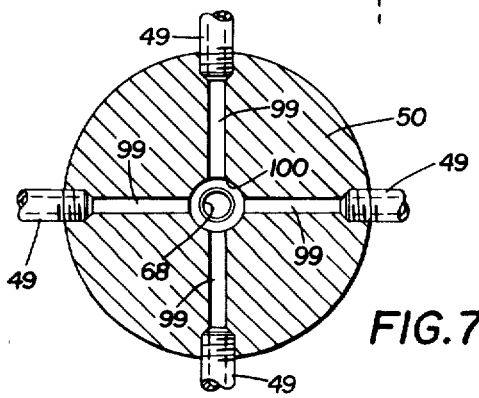
FIG.7B
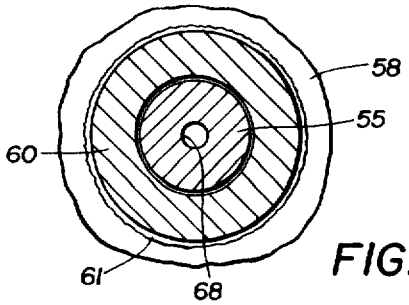
FIG.7A

CLEANING DEVICE FOR SURFACES

BACKGROUND OF THE INVENTION

1. Field of the Invention

The invention relates to a device for cleaning large flat surfaces such as concrete flooring and roadways, and particularly for removing gravel and debris from a flat roof prior to resurfacing the same. More particularly, the invention relates to a device which applies high pressure streams of a fluid against the roof surface to loosen the gravel therefrom, and which then picks up the dirty fluid and loosened gravel from the roof by suction.

2. Description of the Prior Art

Many industrial and commercial buildings have flat roofs which are covered with layers of asphalt-saturated sheet materials that are laid upon the roof surface and cemented together. Additional coatings of asphalt or tar then are placed on the roof to form a waterproof covering for the roof. A layer of pea gravel and small rocks also is spread on the hot asphalt to provide a protective covering for the roof and saturated sheets against physical damage and weather deterioration. After a certain length of time, these asphalt/gravel roofs must be rehabilitated to prevent leaks since such roofs only have a limited life span.

The repair procedure or rehabilitation includes initially removing the gravel cover, much of which has loosened from the asphalt, together with all of the ambient dust and dirt which has settled on the roof throughout the years. After removal of the gravel, dust and dirt, a new layer of tar then is applied to the roof surface, with a new layer of gravel being placed thereon.

Removal of the old gravel and dirt from the roof is a difficult and time-consuming operation. One common procedure for removing these materials is by sweeping the roof with heavy brooms which takes considerable time and personnel to accomplish a satisfactory result. Also, dust and dirt are stirred up by the sweeping and gravel removal on the roof, which is objectionable to people in the vicinity of the building.

To overcome this problem, various sweepers and cleaning devices have been designed, which in addition to removing the gravel from the roof by a source of high suction, use streams of water sprayed against the roof during the removal process. This reduces the dust created by the sweeping action and assists in loosening the gravel and dirt from the roof. One example of such a system is shown in U.S. Pat. No. 3,955,236. This system, as well as other similar systems, consists of a remote unit located on the ground adjacent the building which produces a vacuum that is connected to a cleaning wand or machine movable over the roof surface. Also, in addition to applying the suction source, these units provide a source of high-pressure water to the cleaning head to facilitate removal of the gravel and dirt from the roof.

Further examples of various cleaning devices for cleaning roadways, pavements or other flat surfaces which use a cleaning fluid in combination with a source of suction for loosening and removing the dirt from the surface being cleaned are shown in U.S. Pat. Nos. 3,694,263, 3,837,038, 3,959,010, 4,107,816, 4,168,562, 4,191,590 and 4,219,155. Although these units and others similar thereto are believed to perform satisfactorily for their intended purpose, they do present certain problems and difficulties.

Many of these prior cleaning devices are large and bulky which makes it extremely difficult to transport them onto the roof of a commercial or industrial building for removing the gravel and dirt therefrom. These large units also are difficult to move across the roof and maneuver about the various ventilating ducts, pipes, air conditioning units and other obstructions on a roof.

These prior cleaning devices must be large in order to provide a sufficient suction force for removal of the gravel and dirt and to provide the high pressure for the cleaning fluid. Also, the known cleaning devices which use rotating spray nozzles require a separate motor for driving the spray nozzles, which increases the weight and size of the cleaning unit. Another problem with prior cleaning devices is that leaks commonly occur due to the high pressure of the cleaning fluid, especially in those devices in which the nozzles are rotatably mounted on the unit. It is difficult to achieve an efficient leakproof seal between the stationary components and the rotating nozzle rotor. Also, these prior devices require large vacuum-producing motors and compressors, which even if located on the ground adjacent the building, increases considerably the initial cost of the equipment as well as the power and energy requirements for operating the same. Another problem with these prior devices is that it is difficult to move these large units closely adjacent to the various obstructions on a roof in order to clean the gravel and dirt from the corners and edges along these obstructions. All of these factors increase the cost in order to provide an efficient cleaning job for a customer.

Therefore, the need has existed for a mobile device for cleaning large flat surfaces, and in particular for removing gravel and dirt from a roof to be resurfaced, which provides a large suction force with smaller equipment than heretofore possible, thereby reducing initial equipment cost and energy cost for operating the same, which enables a fluid to be sprayed onto the surface being cleaned under a relatively high pressure by providing an efficient seal and bearing unit for mounting the rotating nozzles, and in which the device is relatively lightweight and easily moved across the surfaces being cleaned. I know of no apparatus other than my cleaning device, which is described below, which achieves these results in as efficient and satisfactory a manner.

SUMMARY OF THE INVENTION

Objectives of the invention include providing a device for cleaning large flat surfaces such as roadways, storage areas, and primarily for removing gravel and dirt from a flat roof prior to resurfacing the same. Another object is to provide such a device which has a plurality of rotatably mounted nozzles which apply a high-pressure spray of cleaning fluid against the surface being cleaned to dislodge the dirt and gravel therefrom for subsequent removal from within a spray chamber by a source of suction connected to the spray chamber. Another object is to provide such a cleaning device which can be moved manually and easily across a surface being cleaned and which can be moved closely adjacent to various obstructions on the roof to enable the gravel and dirt to be completely removed from adjacent these obstructions, and in which the device is relatively lightweight due to the elimination of additional components heretofore required for rotating the spray nozzles. Still another object is to provide such a cleaning device in which the rotating nozzles are mounted and driven by an improved fluid-powered rotor which uses the pressure of the fluid being discharged from the nozzle to rotate the nozzles, and in which an improved rotor and seal assembly enables the nozzles to rotate easily in their mounting on the housing without leaking and with minimum bearing failure by reducing the amount of dirt and fluid which heretofore would enter the bearings and ultimately result in their destruction.

Another object is to provide such a cleaning device in which exhaust ducts are attached to the front and rear walls of the housing which forms the spray chamber, with two additional exhaust ducts being mounted on the top wall of the housing adjacent the sides thereof so that the majority of the dirt and gravel is removed from the spray chamber by the front and rear ducts which are at a lower elevation than the top wall mounted ducts thereby eliminating the gravel and dirt from passing through the revolving nozzles as in prior constructions, and in which the spent cleaning fluid is removed mainly through the top wall mounted exhaust ducts, all of which provides for increased pickup and removal efficiency and reduction of wear on the unit and components thereof. Still another object is to provide such a cleaning device in which the spray chamber housing is adjustably mounted with respect to the surface being cleaned by adjustable wheels so that the air passages formed between the bottom edges of the housing walls and surface are regulated to a predetermined size so that the total area of these air passages is approximately equal to the total area of the exhaust duct openings and, correspondingly, to the area of the suction line in order to achieve the most efficient suction for removal of the dirt and gravel, thereby reducing the size of the various components required to produce the suction force. It is another object to provide such a cleaning device which is of a relatively simple construction, which eliminates maintenance and repair problems, which achieves the stated objectives in a simple, effective and efficient manner, and which solves problems and satisfies needs exiting in the art.

These and other objects and advantages may be obtained by the improved cleaning device for surfaces, the general nature of which may be stated as including a housing having top, front, rear and side walls and an open bottom, said walls forming a spray chamber therebetween; means mounted on the housing for movably supporting the housing on a surface being cleaned; exhaust duct means operatively connected to certain walls of the housing and communicating with the spray chamber for removing debris and spent cleaning fluid from the spray chamber, said exhaust duct means also being connectable to a source of suction for drawing said debris and cleaning fluid from the spray chamber; a plurality of nozzles rotatably mounted on the housing and located within the spray chamber for directing a spray of cleaning fluid toward the surface being cleaned; a manifold having a plurality of inlet openings and an outlet opening, said exhaust duct means being connected to the inlet openings and said outlet opening being connectable to a source of suction, with the total area of the inlet openings being approximately equal to the area of the outlet opening; fluid rotor means mounted on the housing and rotatably mounting the nozzles on said housing, said fluid rotor means being connectable to an incoming source of cleaning fluid with said incoming fluid providing the sole source of power to rotate the nozzles within the spray chamber; and adjustment means operatively engageable with the housing for raising the open bottom of the housing a predetermined distance above the surface being cleaned to form air passages between said surface and the bottom edges of the housing walls, with the total areas of the air passages being approximately equal to the total area of the exhaust duct openings.

BRIEF DESCRIPTION OF THE DRAWINGS

A preferred embodiment of the invention—illustrative of the best mode in which applicant has contemplated applying the principles—is set forth in the following description and shown in the drawings and is particularly and distinctly pointed out and set forth in the appended claims.

FIG. 1 is a top plan view of the improved surface cleaning device;

FIG. 1A is an enlarged sectional view taken on line 1A—1A, FIG. 1;

FIG. 2 is a rear end elevational view of the cleaning device looking in the direction of arrows 2—2, FIG. 1;

FIG. 3 is a left-hand side elevation of the improved cleaning device of FIG. 1;

FIG. 7 is a greatly enlarged fragmentary sectional view of the fluid motor rotor and seal assembly of the improved cleaning device taken on line 7—7, FIG. 1;

FIG. 7A is a reduced sectional view taken on line 7A—7A, FIG. 7;

FIG. 7B is a reduced sectional view taken on line 7B—7B, FIG. 7;

FIG. 8 is a fragmentary sectional view taken on line 8—8, FIG. 7;

Similar numerals refer to similar parts throughout the drawings.

DESCRIPTION OF THE PREFERRED EMBODIMENT

Figure 4:
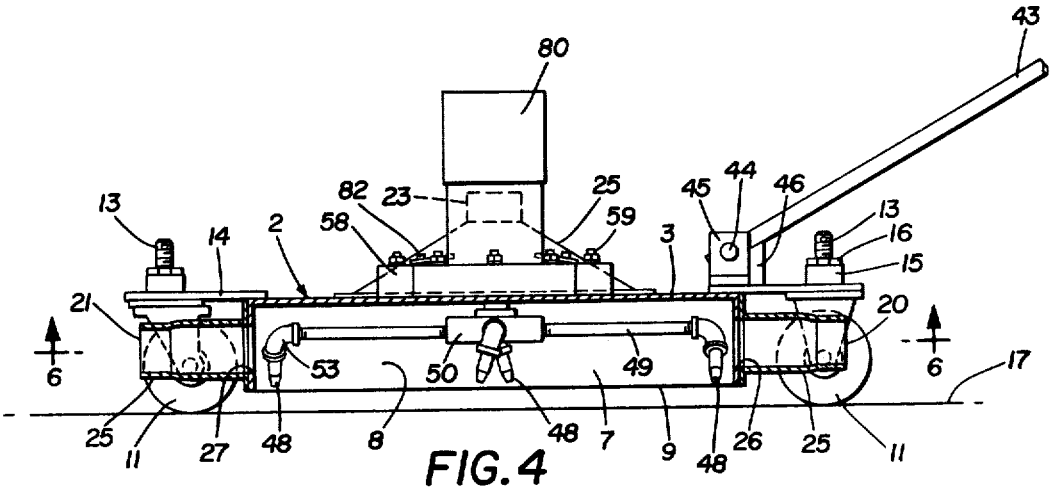
FIG. 4 is an enlarged sectional view taken on line 4—4, FIG. 1.
Figure 5:
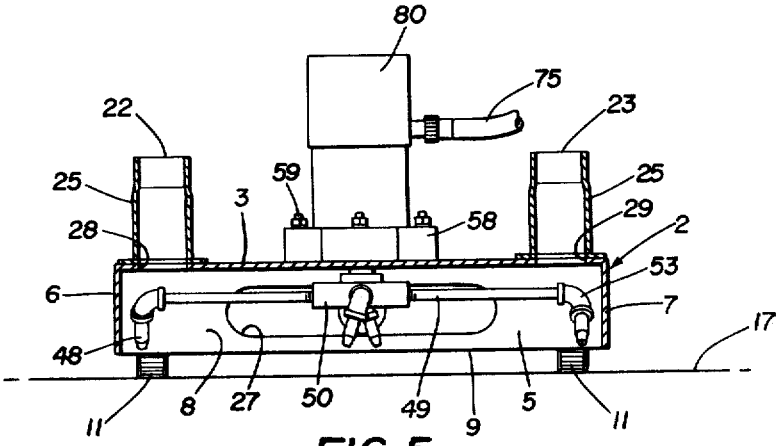
FIG. 5 is an enlarged sectional view taken on line 5—5, FIG. 1.
Figure 6:
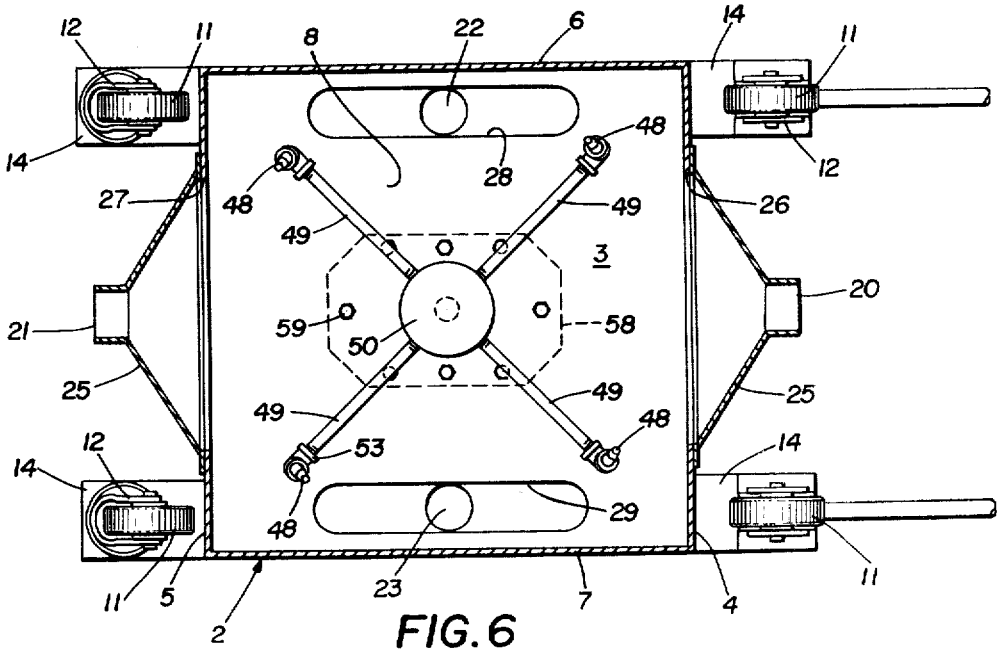
FIG. 6 is a sectional view taken on line 6—6, FIG. 4.

The improved cleaning device is indicated generally at 1, and is shown in assembled condition in FIGS. 1-6. Device 1 includes a housing, indicated generally at 2, formed by top wall 3, front and rear walls 4 and 5, and side walls 6 and 7, which form a spray chamber 8 therebetween having an open bottom 9. Housing 2 preferably is formed of stamped metal sheets with the corners being welded to form an enclosed chamber without any air spaces between the mating side walls. Alternatively, housing 2 may be formed of metal plates welded along their abutting joints.

In accordance with one of the features of the invention, housing 2 is movably supported by wheels 11, which are adjustably mounted on the four corners of housing 2. Wheels 11 are rotatably mounted on a yoke-like bracket 12 which is adjustably mounted by a threaded shaft 13 on a wheel mounting plate 14. Plates 14 are attached to the ends of housing top wall 3 and project outwardly horizontally therefrom. An adjustment nut 15 and lock nut 16 are mounted on each threaded shaft 13 for adjusting the vertical height of housing 2 with respect to wheels 11. Threaded shafts 13 and adjusting nuts 15 enable the spacing between the bottom edges of the housing walls and, correspondingly, between the open bottom of spray chamber 8, to be adjusted to a predetermined height above a surface 17 that is to be cleaned by device 1 to achieve the most efficient suction and debris pickup action, as described in greater detail below.

In accordance with another feature of the invention, four exhaust ducts, indicated generally at 20, 21, 22 and 23, are mounted on housing 2 and communicate with spray chamber 8 for removing the debris and dirt from surface 17 together with the spent cleaning fluid which is sprayed onto the surface. Exhaust ducts 20 and 21 are mounted on front and rear walls 4 and 5, respectively, and exhaust ducts 22 and 23 are mounted on top wall 3 adjacent side walls 6 and 7, respectively. Each exhaust duct includes a funnel-shaped member 25 which is attached by bolts, welding, or other fastening means to its respective wall. Each funnel member 25 of exhaust ducts 20–23 is in alignment with an oval-shaped opening 26, 27, 28 and 29, respectively, formed in its respective walls 3, 4 and/or 5. Flexible hoses 31, 32, 33 and 34 are connected to the funnel-shaped members 25 of exhaust ducts 20–23, respectively, by an L-shaped elbow 35.

In accordance with another feature of the invention, hoses 31–34 are connected to a main suction line 37 by a manifold 38 (FIGS. 1 and 1A). It has been found that to achieve the most efficient suction for removal of the debris and spent cleaning fluid from within spray chamber 8, the cross-sectional area of opening 39 of main suction line 37 is equal to the total cross-sectional area of openings 40 of flexible hoses 31–34. For example, when hoses 31–34 have a three-inch internal diameter, they provide a total area of 28.27 square inches which is equal to the opening area of a single six-inch internal diameter hose 37 used for the main suction line. Other hose size combinations can be used in order to obtain such an opening area matching, as is achieved by the four three-inch exhaust duct hoses 31–34 and the single six-inch main suction line hose 37.

Housing 2 is adapted to be manually rolled across surface 17 by a handle 43 which is pivotally mounted by pins 44 on a pair of brackets 45 which are attached to the rear wheel brackets 14. A stop block 46 preferably is mounted on each bracket 14 adjacent and rearwardly of handle bracket 45 to prevent handle 43 from pivoting downwardly below a predetermined position. This retains handle 43 at a minimum lowered position to facilitate its use by an operator.

A plurality of spray nozzles 48 (FIGS. 4–6) are mounted on the extended ends of a complementary number of spray arms 49. Arms 49 are attached to a disc-shaped mounting block 50 (FIG. 7B) and extend radially outwardly therefrom. Block 50 is rotatably mounted in the center of spray chamber 8 by an improved fluid-powered rotor assembly indicated generally at 52, for applying a cleaning fluid on surface 17 through spray nozzles 48. Spray nozzles 48 are of a usual construction and are threadably connected by an elbow 53 to the extended ends of spray arms 49. Arms 49 are hollow pipes threadably connected to mounting block 50 (FIG. 7B).

One form of improved fluid rotor assembly 52 is shown in FIG. 7. Rotor 52 includes a lower rotor shaft 55 which is rotatably mounted on housing top wall 3 by a pair of spaced roller bearing rings 56 which are interposed between lower shaft 55 and a rotor mounting block, indicated generally at 57. Mounting block 57 includes a lower portion 58 which is mounted by bolts 59 to housing top wall 3 and an upper portion 60 which is attached by welds 61 to lower portion 58. A disc-shaped end cap 62 is attached by screws 63 on the top end of upper block portion 60 and is in abutting engagement with top bearing ring 56 to retain the bearing rings and lower rotor shaft 55 in position within rotor mounting block 57.

Rotor assembly 52 further includes an upper rotor shaft portion 65 which terminates at one end in a threaded portion 66 which is engaged with and connected to lower rotor shaft portion 55. Upper shaft portion 65 includes a central bore 67 which extends throughout a major portion of shaft portion 65 and which is axially aligned and communicates with a longitudinal bore 68 which is formed in and extends throughout the length of lower rotor shaft portion 55. A collar 69 is formed integrally with upper shaft portion 65 on which is seated a sealing block 71.

In accordance with one of the features of the invention, sealing block 71 provides a fluid-tight seal between stationary block 71 and the rotary upper shaft portion 65. Sealing block 71 has a cylindrical configuration, as shown in FIG. 8, and is formed with a longitudinal bore 72 which extends completely throughout the length of block 71. A radially extending threaded opening 73 is formed in sealing block 71 and communicates with bore 72. A threaded nipple 74 is mounted in radial opening 73 and is connected to an incoming fluid supply line 75 by a threaded coupler 76. Sealing block opening 73 communicates with rotor bores 67 and 68 through a pair of radially aligned holes 77 formed in upper shaft portion 65. Openings 77 are arranged in a diametric relationship, as shown in FIG. 8. Nipple 74 extends through a complementary-shaped hole 79 formed in a closed end cylindrical-shaped cover 80. Cover 80 is mounted on the top of lower rotor mounting block portion 58 and is attached thereto by a pair of screw-attached tabs 82 (FIG. 1), to form a protective enclosure for rotor assembly 52.

Sealing block 71, in addition to providing an effective fluid-tight seal with upper rotor shaft portion 65, provides a rotational connection therebetween. A pair of cylindrical bushings 83 are telescopically mounted in a spaced relationship on upper shaft portion 65 and are maintained in the spaced relationship and pressed into abutting engagement with a pair of leather sealing rings 84 by a compression coil spring 85. Spring 85 is telescopically mounted on upper rotor shaft portion 65 and located within sealing block bore 72. Leather sealing rings 84 are mounted within annular grooves 86 formed within sealing block bore 72 at opposite ends of the bore.

In addition to the sealing effect provided by spaced leather sealing rings 84, a pair of O-rings 90 which are telescopically mounted on shaft portion 65, are pressed into sealing engagement with block 71 and shaft portion 65 by spring 85. A pair of washers 92 are telescopically mounted on shaft portion 65 and are interposed between O-rings 90 and bushings 83 and are pressed into abutting engagement with the inner edges of bushings 83 by spring 85. Sealing block 71 is mounted on collar 69 of rotor shaft portion 65 and retained thereon by upper and lower washers 88. Lower washer 88 is supported on the top of shaft collar 69 and upper washer 88 is maintained in engagement with the top surface of sealing block 71 by a snap ring 89.

This construction provides an effective and efficient liquid seal between stationary sealing lock 71 and rotary shaft portion 65 due primarily to the biasing force exerted by spring 85 which presses O-rings 90 into sealing engagement with shaft portion 65 and sealing block 71, while permitting the rotor shaft to rotate on bushings 83.

The bottom end of lower rotor shaft portion 55 has a reduced threaded end 95 which extends through a hole 96 formed in top wall 3 of housing 2 where it is threadably engaged within a complementary-shaped bore 97 formed in spray arm mounting block 50. Spray arm mounting block 50 is formed with four equally spaced radially extending ports 99 (FIGS. 7 and 7B) which extend radially outwardly from central opening 100. Ports 99 and block opening 100 communicate with rotor shaft bore 68 through which a cleaning fluid is supplied to the individual spray arms 49.

The operation of cleaning device 1 and of rotor assembly 52 is as follows:

Cleaning device 1 is moved to the roof of a building, and cleaning fluid supply line 75 is attached to a source of cleaning fluid. In most all applications, the cleaning fluid will be water, although other types of cleaning fluid or cleaning mixtures could be used satisfactorily with device 1. Also, a Y-valve can be mounted in line 75 with one branch thereof being connected to a supply of compressed air and the other branch being connected to a supply of water. This enables either air or water or a combination thereof to be used as the cleaning fluid. Main suction line 37 is connected to a source of suction which is usually located on the ground adjacent the building. The equipment which produces this suction source will also include filtration or separation means for separating the dirty water or cleaning fluid from the gravel and debris. An example of such remote suction-producing equipment and separation means is shown in U.S. Pat. No. 3,955,236. Another type of mobile unit similar to that of the above mentioned patent is sold by Super Products of Milwaukee, Wis., under its trademark SUPERSUCKER.

Housing 2 is adjusted on wheels 11 by means of adjusting nuts 15 so that predetermined size openings or air passages 130 are formed between the bottom edges of housing walls 4–7 to provide a total air inlet area which is equal to the total area of the exhaust ducts 20–23 which will be equal to the area of the opening of main suction line 37. This relationship between the air inlet and outlet openings will provide a more efficient suction and thereby a more efficient gravel and debris pickup and with smaller and less powerful equipment than with prior cleaning devices.

Referring to FIG. 7, the incoming fluid (preferably water) will enter rotor bores 67 and 68 through line 75 and flow to the individual spray nozzles 48 through arms 49 where the water is sprayed downwardly toward and against surface 17. Tilting of nozzles 48 to an angle of approximately 15° with respect to the vertical will create a sufficient back pressure or force produced by the spray discharge to cause mounting block 50 and, correspondingly, rotor assembly 52 to rotate within mounting block 57 and sealing block 71. The speed of rotation will be determined by the pressure of the incoming cleaning fluid.

The improved rotor mounting and sealing arrangement shown in FIG. 7 and described above enables the nozzles to rotate more easily within spray chamber 8 with a minimum amount of leakage occurring between the rotating rotor components and its stationary mounting block. Thus, as device 1 is moved manually across surface 17 by an operator pushing against handle 43, the rotating nozzles and the fluid being sprayed therefrom will loosen most gravel and dirt from surface 17. The gravel and dirt then are drawn through the exhaust duct and into the remote separation equipment by the suction applied to spray chamber 8.

In accordance with one of the features of the invention, the main portion of the gravel and large dirt particles will be withdrawn from chamber 8 through front and rear exhaust ducts 20 and 21 since their respective openings 26 and 27 are at a lower level than top wall openings 28 and 29 of ducts 22 and 23. With this exhaust duct arrangement, the gravel will not be required to pass upwardly through the revolving nozzle arms as in many prior cleaning devices. Such an arrangement reduces damage and wear on the nozzles and supporting components and provides a more efficient pickup. The majority portion of the dirty cleaning fluid will be exhausted through the top wall exhaust openings 28 and 29. The passage of this spent fluid through the rotating spray arms will not present any problems thereto as will the attempted passage of the gravel and large dirt particles.

Figure 9:
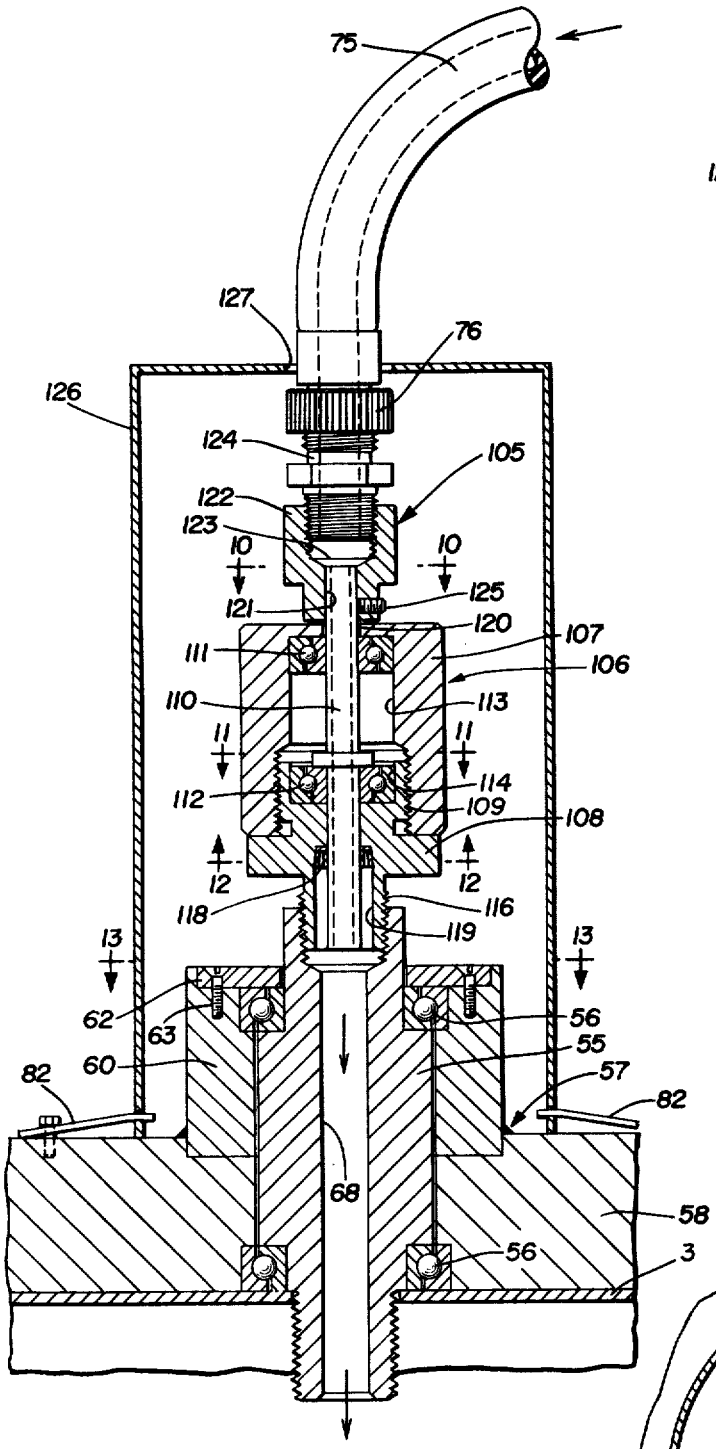
FIG. 9 is a fragmentary sectional view similar to FIG. 7 showing a modified form of the fluid motor rotor and seal assembly.
Figure 10:
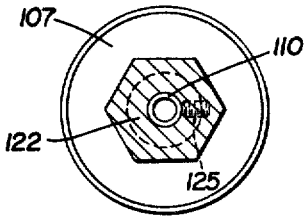
FIG. 10 is a sectional view taken on line 10—10, FIG. 9.
Figure 11:
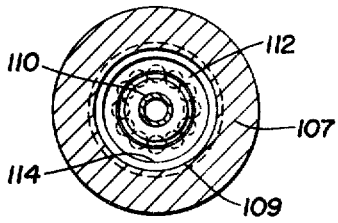
FIG. 11 is a sectional view taken on line 11—11, FIG. 9.
Figure 12:
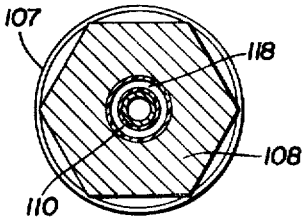
FIG. 12 is a sectional view taken on line 12—12, FIG. 9.
Figure 13:
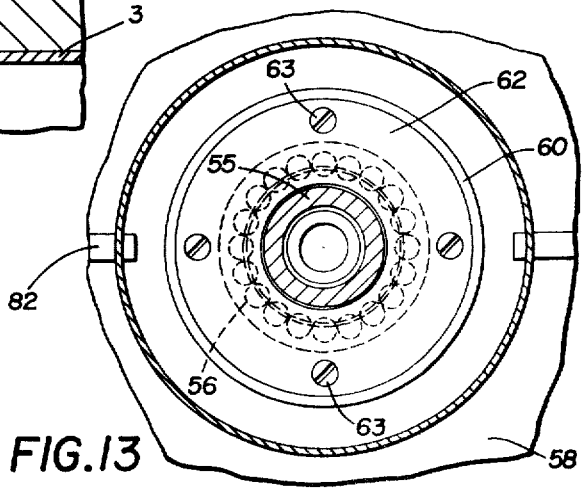
FIG. 13 is a sectional view taken on line 13—13, FIG. 9.

A modified form of the fluid-powered rotor assembly 52 is indicated generally at 105, and is shown in assembled operating condition on housing top wall 3 in FIG. 9. Further details of rotor assembly 105 are shown in FIGS. 10–13. The lower half of rotor 105 is similar to that of rotor 52 and therefore is not discussed in detail. The differences between the two rotors is in the upper half-section thereof.

The upper section of modified motor 105 includes an upper rotor shaft portion, indicated at 106, which consists of an inverted cup-shaped member 107 which is threadably connected to a lower base section 108 by a threaded connection 109. Connection 109 joins member 107 and base section 108, whereby they will rotate in unison as described in greater detail below. Rotor shaft portion 106 is rotatably mounted on a stationary delivery tube 110 by a pair of spaced bearing rings 111 and 112. Upper bearing ring 111 is inserted within the hollow interior 113 of cup-shaped member 107 with lower bearing ring 112 being seated within an annular recess 114 formed in the upper end of base section 108. Upper rotor section 106 is connected to lower shaft section 55 by a reduced threaded end 116 formed on base section 108.

In accordance with one of the features of modified rotor 105, a frustro conical-shaped sealing ring 118 is telescopically mounted on the lower end of delivery tube 110 within an enlarged partial bore 119 formed in threaded end 116 of base section 108.

The upper end of delivery tube 110 extends through a circular opening 120 formed in the end wall of cup-shaped member 107 and through an aligned circular hole 121 formed in the bottom of a coupler 122. Coupler 122 is formed with an interior bore 123 in which a threaded nipple 124 is engaged for connecting water line 75 thereto by coupler 76 in a similar manner as discussed above with respect to rotor assembly 52. Deliver tube 110 terminates in coupler bore 123 and is fixedly mounted with respect to coupler 122 by a set-screw 125. The lower end of delivery tube 110 terminates in and communicates with longitudinal bore 68 of lower rotor shaft 55 for supplying cleaning fluid to the spray arms 49. Modified rotor assembly 105 is enclosed by a cover 126. Cover 126 is similar to cover 80 except that a fluid inlet line opening 127 is formed in the top wall of cover 126 instead of in the side wall as in housing 80 for admitting fluid inlet line 75.

The operation of modified fluid-powered rotor 105 is generally similar to that of rotor assembly 52. The back pressure of the cleaning fluid leaving the spray nozzles will rotate nozzle arm mounting block 50 and lower rotor shaft 55 and connected upper rotor shaft 106. Shaft portion 55 rotates on spaced bearing rings 56 and shaft portion 106 will rotate on delivery tube 110 by spaced bearing rings 111 and 112. The incoming fluid will flow from line 75 into bore 123 of coupler 122 and downwardly through delivery tube 110 and into and through longitudinal shaft bore 68 of shaft portion 55 and into spray arm mounting block 50 for distribution to the spaced spray arms 49.

Sealing ring 118 provides the main seal for the rotating shaft with respect to stationary delivery tube 110. The cleaning fluid will fill bore 119 of reduced threaded end 116 of base section 108 and will exert an upward force against sealing ring 118 equal to the pressure of the cleaning fluid to form an effective seal between ring 118 and delivery tube 110. Thus, as the pressure of the incoming fluid increases, the pressure exerted on sealing ring 118 will increase proportionately forming a more effective seal. Thus, the higher the fluid pressure, the greater will be the sealing effect created by sealing ring 118 due to the pressure of the fluid acting on ring 118.

Accordingly, the improved cleaning device provides a construction which is simplified, provides an effective, safe, inexpensive and efficient device which achieves all the enumerated objectives, provides for eliminating difficulties encountered with prior devices, and solves problems and obtains new results in the art.

In the foregoing description, certain terms have been used for brevity, clearness and understanding, but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved cleaning device is constructed and used, the characteristics of the construction, and the advantageous, new and useful results obtained; the new and useful structures, devices, elements, arrangements, parts and combinations are set forth in the appended claims.

I claim:

1. A mobile cleaning device for spraying a cleaning fluid under pressure toward a surface being cleaned, said device ;including:

(a) a housing having top, front, rear and side walls and an open bottom, said walls forming a spray chamber therebetween;

(b) means mounted on the housing for movably supporting the housing on a surface being cleaned;

(c) exhaust duct means operatively connected to certain walls of the housing and communicating with the spray chamber for removing debris and spent cleaning fluid from the spray chamber, said exhaust duct means also being connectable to a source of suction for drawing said debris and cleaning fluid from the spray chamber;

(d) a plurality of nozzles rotatably mounted on the housing and located within the spray chamber for directing a spray of cleaning fluid toward the surface being cleaned;

(e) a manifold having a plurality of inlet openings and an outlet opening, said exhaust duct means being connected to the inlet openings and said outlet opening being connectable to a source of suction, with the total area of the inlet openings being approximately equal to the area of the outlet opening;

(f) fluid rotor means mounted on the housing and rotatably mounting the nozzles on said housing, said fluid rotor means being connectable to an incoming source of cleaning fluid with said incoming fluid providing the sole source of power to rotate the nozzles within the spray chamber; and (g) adjustment means operatively engageable with the housing for raising the open bottom of the housing a predetermined distance above the surface being cleaned to form air passages between said surface and the bottom edges of the housing walls, with the total areas of the air passages being approximately equal to the total area of the exhaust duct openings.

2. The cleaning device defined in claim 1 in which the means mounted on the housing for movably supporting the housing is a plurality of wheels; and in which the adjustment means are operatively engageable with the housing wheels for raising and lowering the housing with respect to said wheels and, correspondingly, to the surface being cleaned.

3. The cleaning device defined in claim 1 in which four exhaust ducts are operatively connected to the housing; and in which first and second of said exhaust ducts are connected to the front and rear housing walls respectively, and in which the third and fourth exhaust ducts are connected to the housing top wall closely adjacent to a respective side wall.

4. The cleaning device defined in claim 1 in which the fluid rotor means includes a rotor shaft having upper and lower rotor shaft sections; in which the lower shaft section is rotatably mounted on the housing top wall by a pair of spaced bearing rings interposed between said lower shaft section and a rotor shaft mounting block fastened to said housing top wall; in which the rotor shaft is formed with a longitudinal bore which communicates with the nozzles at one end and with a source of incoming cleaning fluid at the other end to operatively connect the source of fluid to the nozzles; and in which sealing means is operatively engaged with the upper shaft section of the rotor shaft for preventing leakage of the cleaning fluid as it travels through the shaft bore from the fluid source to the nozzles.

5. The cleaning device defined in claim 4 in which the sealing means includes a sealing block telescopically mounted on the upper section of the rotor shaft; in which a pair of spaced bushing means is interposed between the sealing block and upper shaft section for rotatably mounting said upper shaft section with respect to the sealing block; in which a pair of sealing rings is telescopically mounted in a spaced relationship on the upper shaft section; and in which spring means biases the sealing rings into abutting engagement with the bushing means for forming a pair of spaced fluid seals between the sealing block and upper shaft section.

6. The cleaning device defined in claim 5 in which aligned radially extending openings are formed in the sealing block and upper shaft section; in which said openings are located between the spaced pair of fluid seals and communicate with the bore of the rotor shaft; and in which coupler means is mounted in the radially extending opening of the sealing block for connecting a source of cleaning fluid to the rotor shaft bore.

7. The cleaning device defined in claim 4 in which cover means is mounted on the top wall of the housing and encloses the fluid rotor means.

8. The cleaning device defined in claim 4 in which a stationary tube is located within the bore of the upper shaft section; in which bearing means is mounted on the tube in the bore of the upper shaft section and rotatably mounts said shaft section with respect to said tube; and in which sealing means is interposed between the tube and upper shaft section for forming a fluid seal therebetween.

9. The cleaning device defined in claim 8 in which one end of the stationary tube communicates with the bore of the lower shaft section of the rotor and in which another end of said tube is adapted to be connected to a cleaning fluid supply line.

10. The cleaning device defined in claim 9 in which the upper shaft section includes an inverted cup-shaped member and a base removably connected thereto; in which the stationary tube extends through vertically aligned openings formed in the cup-shaped member and base; and in which the sealing means is a frusto conical-shaped ring telescopically mounted on the tube and located within one of the aligned openings formed in the base.

11. The cleaning device defined in claim 1 in which the cleaning fluid is a liquid.

12. The cleaning device defined in claim 11 in which the cleaning liquid is water.

13. The cleaning device defined in claim 1 in which the cleaning fluid is compressed air.

14. The cleaning device defined in claim 1 in which the cleaning fluid is a mixture of compressed air and water.

15. A mobile cleaning device for spraying a cleaning liquid under pressure toward a surface being cleaned, said device including:

(a) a housing having top, front, rear and side walls and an open bottom, said walls forming a spray chamber therebetween;

(b) wheels mounted on the housing for movably supporting the housing on a surface being cleaned;

(c) exhaust duct means operatively connected to certain walls of the housing and communicating with the spray chamber for removing debris and spent cleaning liquid from the spray chamber, said exhaust duct means also being connectable to a source of suction for drawing said debris and cleaning liquid from the spray chamber;

(d) nozzle means rotatably mounted within the spray chamber for directing a spray of cleaning liquid toward the surface being cleaned;

(e) shaft means rotatably mounted on the housing top wall for rotatably mounting the nozzle means in the spray chamber, said shaft means having upper and lower sections and a longitudinal bore;

(f) means for operatively connecting a cleaning liquid supply line to the shaft means for supplying cleaning liquid to the nozzle means through the bore of said shaft means, said connecting means being stationary with respect to the housing;

(g) a pair of spaced bearing rings operatively engaged with the lower section of the shaft means to rotatably mount the shaft means on the top wall of the housing; and (h) sealing means operatively engaged with the upper section of the shaft and with the stationary liquid supply line connecting means for providing a seal between the rotatable shaft and stationary connecting means.

16. The cleaning device defined in claim 15 in which the connecting means includes a connection block having longitudinal bore in which a portion of the shaft upper section is telescopically mounted; in which a radially extending inlet port is formed in the connection block and communicates with the shaft bore through a radially extending hole formed in the shaft upper section; and in which the liquid supply line is adapted to be connected to said inlet port for supplying cleaning liquid to the nozzle means through the shaft bore.

17. The cleaning device defined in claim 16 in which a pair of sealing rings is telescopically mounted on the shaft upper section and located within the bore of the connection block, said rings being located each on an opposite side of the inlet port and radial hole of the connection block and shaft upper section.

18. The cleaning device defined in claim 17 in which a pair of spaced bushings is telescopically mounted on the shaft upper section within the bore of the connection block to provide a rotational connection between said block and upper section; and in which a coil spring is telescopically mounted on the shaft upper section within the bore of the connection block and biases the spaced sealing rings into abutting sealing engagement with the spaced bushings.

19. The cleaning device defined in claim 18 in which a radially extending collar is formed on the shaft upper section; and in which the connection block is mounted on the shaft collar.

20. The cleaning device defined in claim 15 in which the upper and lower shaft sections are detachably connected by a threaded connection therebetween.

21. The cleaning device defined in claim 15 in which the shaft upper section includes an inverted cup-shaped member and a base member detachably connected thereto, said members having hollow interiors forming a portion of the shaft bore; in which the connecting means includes a hollow delivery tube telescopically mounted in the interiors of the cup-shaped member and base member and communicating with the shaft bore within the shaft lower section; in which bearings are mounted in the hollow interiors of the shaft upper section members and are telescopically mounted on the delivery tube to rotatably mount the shaft upper section with respect to said tube; and in which the sealing means includes a sealing ring telescopically mounted on the delivery tube within the hollow interior of the shaft upper section base member.

22. The cleaning device defined in claim 21 in which the shaft upper section terminates in a threaded end which is detachably connected to the shaft lower section; in which the sealing ring is located within the bore of the threaded end; and in which the threaded end bore communicates with the bore of the shaft lower section whereby the pressure of the cleaning liquid which passes through the shaft lower section bore is applied to the sealing ring to press said sealing ring against the delivery tube and base member of the shaft upper section.

23. The cleaning device defined in claim 21 in which the delivery tube has top and bottom ends; in which a coupler is mounted on the top end of the delivery tube for connecting said tube to the liquid supply line; and in which the bottom end of the tube terminates in the bore of the shaft lower section.

24. The cleaning device defined in claim 22 in which the sealing ring has a frustro-conical shape.

25. The cleaning device defined in claim 15 in which the cleaning liquid is water.

26. The cleaning device defined in claim 25 in which the cleaning water is mixed with compressed air.

* * * * *